United States Patent [19]

Clarke et al.

[11] 4,156,655

[45] May 29, 1979

[54] GREASE COMPOSITION RESISTANT TO SALT WATER CORROSION

[75] Inventors: George A. Clarke; Gary L. Harting, both of Westfield, N.J.

[73] Assignee: Exxon Research & Engineering Co., Florham Park, N.J.

[21] Appl. No.: 873,147

[22] Filed: Jan. 30, 1978

[51] Int. Cl.[2] ..... C10M 3/18; C10M 5/14; C10M 7/20; C10M 7/24

[52] U.S. Cl. ..... 252/18; 252/25; 252/389 R

[58] Field of Search ..... 252/18, 25, 389 R

[56] References Cited

U.S. PATENT DOCUMENTS

| | | | |
|---|---|---|---|
| 3,271,309 | 9/1966 | Caruso | 252/21 |
| 3,623,982 | 11/1971 | Scott | 252/34 |
| 3,730,896 | 5/1973 | Scott et al. | 252/34.7 |
| 3,758,407 | 9/1973 | Harting | 252/18 |
| 3,791,973 | 2/1974 | Gilani et al. | 252/41 |
| 3,940,339 | 2/1976 | Clarke et al. | 252/18 |
| 3,985,662 | 10/1976 | Campbell et al. | 252/41 |

*Primary Examiner*—Delbert E. Gantz
*Assistant Examiner*—Irving Vaughn
*Attorney, Agent, or Firm*—Eugene Zagarella, Jr.

[57] ABSTRACT

A lubricating grease composition is provided having improved salt water corrosion resistance and comprising a lithium complex grease thickener, a metal naphthenate and a quaternary ammonium salt.

12 Claims, No Drawings

GREASE COMPOSITION RESISTANT TO SALT WATER CORROSION

BACKGROUND OF THE INVENTION

This invention relates to a novel lubricating grease composition having improved salt water corrosion resistance. More particularly, this invention involves a lubricating grease composition comprising a lithium complex grease thickener, a metal naphthenate and a quaternary ammonium salt.

Greases thickened with lithium soaps are well known in the prior art and such greases have found wide acceptance in a variety of applications. Generally however, these greases cannot be effectively used in marine applications due to the relatively low resistance to salt water and brackish water corrosion.

It is well known that rust inhibitors and various other additives can be incorporated into grease compositions to provide or improve the properties of such greases. For example, U.S. Pat. No. 3,271,309 issued Sept. 6, 1966 to G. P. Carusso discloses an oleophilic, ammonium modified, clay thickened grease containing a metal carbonate and optionally a molybdenum or antimony sulfide and lead naphthenate to improve the extreme pressure properties. U.S. Pat. No. 3,623,982 issued Nov. 30, 1971 to W. P. Scott discloses conventional calcium base greases containing a combination of lead naphthenate, a dialkyl dimethyl quaternary ammonium nitrite or nitrate and optionally a fatty imidazoline alkyl diamine dicaprylate as a rust inhibiting package. While the patent indicates the general suitability of the so modified calcium base greases in marine applications involving a salt water environment, it specifically notes that such a rust inhibiting additive combination is not effective in preventing salt water corrosion when added to lithium base greases.

U.S. Pat. No. 3,730,896 issued May 1, 1973 to W. P. Scott et al discloses a low temperature grease composition having effective rust inhibiting properties and comprising a major proportion of a synthetic hydrocarbon lubricant, such as a monoalkylated benzene, a grease-forming amount of a lithium soap of a fatty acid and a rust inhibiting amount of lead naphthenate, didodecyl dimethyl quaternary ammonium nitrite or nitrate and a fatty imidazoline alkyl diamine dicaprylate. As noted in the patent, this particular rust inhibitor combination while effective in providing salt water rust protection in a lithium soap-synthetic hydrocarbon lubricant grease, was not effective in a conventional lithium soap-petroleum oil grease.

U.S. Pat. No. 3,940,339 issued Feb. 24, 1976 to G. A. Clarke et al discloses a lubricating grease having an exceptional ability to protect metal bearing surfaces against rusting or corrosion in the presence of salt water and comprises a lithium complex grease thickener made up of a lithium soap of $C_{12}$ to $C_{24}$ hydroxy fatty acid and boric acid and a corrosion inhibiting combination of a dialkyl dimethyl ammonium nitrite and an amino imidazoline. While this grease composition did provide excellent salt water corrosion resistance, it was not particularly suitable in applications involving the use of rubber seals since it often caused embrittlement of the rubber.

SUMMARY OF THE INVENTION

Now it has been discovered that a lubricating grease composition having improved salt water corrosion resistance is provided by a composition containing a lithium complex grease thickener and a rust inhibiting additive package comprising a metal naphthenate and a quaternary ammonium salt.

Accordingly, it is an object of this invention to provide a lubricating grease composition which is particularly useful in marine applications involving a salt water environment. It is another object of this invention to provide a lithium base grease composition using conventional lubricating base compositions and having good salt water corrosion resistance. It is still another object of this invention to provide a suitable lithium base grease composition for use in marine applications and which is particularly effective in applications involving rubber components.

In accordance with the present invention, the foregoing and other objects and advantages are accomplished with a lubricating composition comprising a major proportion of a base oil, from about 2 to about 30 wt.% of a thickener system whose components include a lithium soap of a $C_{12}$ to $C_{24}$ hydroxy fatty acid and a monolithium salt of boric acid and a rust inhibiting amount of a combination of metal naphthenate wherein the metal is selected from the metals of Group I to IV of the Mendeleev periodic table and more particularly, from the group consisting of zinc, lead, lithium and magnesium and a quaternary ammonium salt having a di-lower alkyl group of about 1 to about 3 carbon atoms and additional dialkyl groups of about 8 to about 24 carbon atoms.

DETAILED DESCRIPTION OF THE INVENTION

The present invention, as previously indicated, relates to a lubricating grease composition having improved salt water corrosion and comprising a lithium complex grease thickener, a metal naphthenate and a quaternary ammonium salt.

In general, a variety of metallic salts of naphthenic acid can be used in the rust inhibitor of the present invention. As is well known, the term "naphthenic" acids is applied to mixtures of carboxylic acids generally obtained from the alkali washes of petroleum fractions. Generally, the naphthenic acids are complex mixtures of normal and branched aliphatic acids, alkyl derivatives of cyclopentane and cyclohexane carboxylic acids and cyclopentyl and cyclohexyl derivatives of aliphatic acids. The naphthenate may be a salt formed from metals of Group I to IV of the Mendeleev periodic table with the alkali and alkaline earth metal salts and the heavy metal salts being most effective and are, therefore, particularly useful. Zinc, lead, lithium and magnesium are the particularly preferred metal naphthenates used in this invention.

A variety of quaternary ammonium salts generally can be used in the rust inhibitor composition of the present invention. As is well known, quartenary ammonium salts may be represented by the following structural formula:

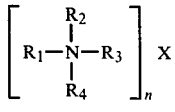

wherein $R_1$, $R_2$, $R_3$ and $R_4$ are either the same or different organic radicals, X is an acid anion and n is a number equal to valence of said anion.

In general, $R_1$, $R_2$, $R_3$ and $R_4$ may be any organic radical including both substituted and unsubstituted hydrocarbon moieties. Best results are, however, realized when $R_1$, $R_2$, $R_3$ and $R_4$ are selected from the straight and branched chained alkyl and alkenyl radicals. In all cases, the organic radicals will be selected so as to facilitate solubility in the base oil used in preparing the grease and when such organic radicals are an alkyl or alkenyl group, the same will, generally have from about 1 to about 30 and preferably from about 1 to about 24 carbon atoms. Particularly useful quaternary compounds are the ammonium salts containing di-lower alkyl groups of about 1 to about 3 carbon atoms and di-higher alkyl groups of about 8 to about 24 carbon atoms. The particularly preferred quaternary compounds are the dimethyl, dialkyl ammonium salts wherein the alkyl groups contain about 10 to about 20 and more preferably about 12 to about 18 carbon atoms.

The nature of the anionic radical X, is not critical and may be a halide, such as chloride, bromide and iodide, an alkoxy radical such as methoxy and ethoxy, a weak acid radical like acetate or a strong acid radical like sulfate, nitrate or hydroxide. Particularly preferred are the stronger acids and more particularly the nitrogen containing acids such as nitric, nitrous and hyponitrous acid. A particularly preferred quaternary ammonium compound is dimethyl dicocoammonium nitrite.

The lithium thickened grease compositions which may be used in this invention comprise a complex of a lithium soap of hydroxy fatty acid and boric acid.

The hydroxy fatty acid employed in preparing the greases of this invention will have from about 12 to about 24, and preferably about 16 to about 20 carbon atoms. A particularly preferred hydroxy fatty acid is hydroxystearic acid, e.g., 9-hydroxy, 10-hydroxy, or 12-hydroxystearic acid, and more preferably the latter. Ricinoleic acid, which is an unsaturated form of 12-hydroxystearic acid, having a double bond in the 9-10 position, can also be used. Other useful hydroxy fatty acids include 12-hydroxybehenic acid and 10-hydroxypalmitic acid.

A second hydroxycarboxylic acid may be used along with the boric acid and hydroxy fatty acid and it will generally have an OH group attached to a carbon atom that is not more than 6 carbon atoms removed from the carboxyl group. This acid has from about 3 to about 14 carbon atoms and can be either an aliphatic acid such as lactic acid, 6-hydroxydecanoic acid, 3-hydroxybutanoic acid, 1-hydroxycaproic acid, 4-hydroxybutanoic acid, 6-hydroxy-alpha-hydroxystearic acid, etc. or an aromatic acid such as parahydroxy-benzoic acid, salicylic acid, 2-hydroxy-4-hexylbenzoic acid, metahydroxybenzoic acid, 2,5-dihydroxybenzoic acid (gentisic acid); 2,6-dihydroxybenzoic acid (gamma resorcyclic acid); 4-hydroxy-4-methoxybenzoic acid, etc. or a hydroxyaromatic aliphatic acid such as orthohydroxyphenyl, metahydroxyphenyl, or parahydroxyphenyl acetic acid. A cycloaliphatic hydroxy acid such as hydroxycyclopentyl carboxylic acid or hydroxynaphthenic acid could also be used. Particularly useful hydroxy acids are lactic acid, salicylic acid, and parahydroxybenzoic acid.

Instead of using the free hydroxy acid of the latter type when preparing the grease, one can use a lower alcohol ester, e.g., the methyl, ethyl, or propyl, isopropyl, or sec-butyl ester of the acid, e.g., methyl salicylate, to give a better dispersion when the salt is insoluble.

The lithium grease composition used in this invention may also comprise a combination of at least one lithium soap derived from a fatty acid containing a functional group, such as a hydroxy group, an epoxy group and ethylene unsaturation, and at least one dilithium soap derived from a straight chain dicarboxylic acid.

When a hydroxy- or epoxy-substituted fatty acid is used, the same will be represented generally by the following structural formulae:

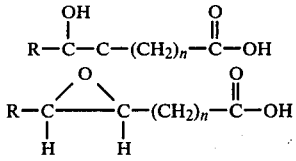

(I)

(II)

wherein R in either formula may be H or a straight or branched chain hydrocarbon radical containing from about 1 to about 27 carbon atoms and n is a whole number ranging from 0 to 27, it being understood that the total number of carbon atoms in both R and $(CH_2)_n$ is from about 5 to about 27, and hence, when R contains 27 carbon atoms, n must be zero, and when n is 27, R must be H. In the preferred embodiment, n will range from 7 to 13 thus providing a straight chain hydrocarbon radical containing from about 7 to about 13 carbon atoms and R will be either H or a straight or a branched chain hydrocarbon radical containing from about 1 to about 10 carbon atoms. In a most preferred embodiment, n will be 7 and R will be a straight chain hydrocarbon radical containing 8 carbon atoms.

The ethylenically unsaturated fatty acids which are useful in the present invention, on the other hand, are illustrated, generally, by the structural formula:

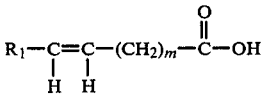

wherein $R_1$ is independently selected from the same group of radicals as R in the previously described formula and m is a whole number from 0 to 27 in the same manner as n may range from 0 to 27 in the previous formula. Similarly, $R_1$ and m will satisfy all other limitations set forth in the discussion of the previous formula with respect to R and n, respectively, and this is true even with respect to the preferred and most preferred species.

A second hydroxycarboxylic acid may be used along with the lithium soap derived from a functionally substituted fatty acid and the dilithium soap derived from dicarboxylic acid. This second acid will have from about 3 to about 14 carbon atoms and will have an OH group attached to a carbon atom that is not more than 6 carbon atoms removed from the carboxyl group in the manner described above in the earlier noted embodiment.

Hydroxy-substituted fatty acids which can be used as the base thickening agent in combination with the dilithium component include 9-, 10- and 12-hydroxystearic acid, 12-hydroxybehenic acid and 10-hydroxypalmitic acid. Epoxy-substituted fatty acids which can be used include 12,13-epoxy stearic acid; 15,16-epoxy stearic acid; 9,10-epoxy stearic acid and 9,10-epoxy palmitic acid. Similarly, ethylenically unsaturated fatty acids which could be used include oleic acid, linoleic acid, linolenic acid and palmitoleic acid.

The dicarboxylic acids which can be used in the greases of this invention will have from about 4 to about 12 carbon atoms, preferably about 6 to about 10 carbon atoms. Such acids include succinic, glutaric, adipic, suberic, pimilic, azelaic, dodecanedioic, and sebacic acids. Sebacic acid and azelaic acid are preferred.

The total lithium soap content of the grease compositions of this invention will range from about 2 to about 30 wt.% and peferably from about 5 to about 20 wt.%, based on the total composition, and this will be the case even when more than one lithium soap is used.

When the preferred lithium grease comprising a complex of a lithium soap of hydroxy fatty acid and boric acid is used the proportion of the $C_{12}$ to $C_{24}$ hydroxy fatty acid to boric acid will be in the range of a weight ratio of about 3 to about 100 parts, or more usually about 5 to about 80 parts, of hydroxy fatty acid per part by weight of boric acid. There will be a weight ratio of about 0.1 to about 10, or more usually about 0.5 to about 5 parts of said second hydroxycarboxylic acid per part by weight of boric acid in the case of the greases made from three acid components.

When the lithium grease composition comprises a combination of at least one lithium soap derived from a fatty acid and one dilithium soap derived from a straight chain dicarboxylic acid, the weight ratio of lithium soap of fatty acid to dilithium soap of dicarboxylic acid will be within the range of from about 0.025:1 to about 20:1 and preferably from about 1:1 to about 10:1.

In general, from about 0.05 to about 10 wt.%, preferably from about 0.1 to about 5 wt.%, based on base oil stock, of the quaternary ammonium salt and from about 0.05 to about 10 wt.%, preferably from about 0.1 to about 5 wt.%, of the metallic naphthenate will be incorporated into the grease composition. In general, any suitable method could be used to effect the incorporation and these methods include those wherein the rust inhibitor is combined after the grease has thickened but before the same is cooled and those wherein the rust inhibitor is added directly to the base oil stock prior to thickening. Of these, it is most preferred to incorporate both components of the rust inhibitor into the base oil stock so as to insure optimum distribution in the final composition.

Lithium grease compositions of the type described above are disclosed in U.S. Pat. No. 3,758,407 issued on Sept. 11, 1973, U.S. Pat. No. 3,791,973 issued on Feb. 12, 1974 and U.S. Pat. No. 3,985,662 issued Oct. 12, 1976. Further details and the method of preparing such compositions may be found in such patents.

The lubricating oil base stock that is used in preparing the grease compositions of this invention can be any of the conventionally used mineral oils, synthetic hydrocarbon oils or synthetic ester oils. In general, these lubricating oils will have a viscosity in the range of about 35 to 300 SUS at 210° F. Minerals lubricating oil base stocks used in preparing the greases can be any coventionally refined base stocks derived from paraffinic, naphthenic and mixed base crudes. Synthetic lubricating oils that can be used include esters of dibasic acids, such as di-2-ethylhexyl sebacate, esters of glycols such as $C_{13}$ oxo acid di-esters or tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g. alkylate bottoms from the alkylation of benzene with tetrapropylene, or the polymers and copolymers of alpha olefins; silicone oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethylcarbonate to form a half ester followed by reaction of the latter with tetraethylene glycol, etc. Other suitable synthetic oils include the polyphenyl ethers, e.g. those having from about 3 to 7 ether linkages and about 4 to 8 phenyl groups (see U.S. Pat. No. 3,424,678, column 3).

Having thus broadly and specifically described the present invention, it is believed that the same will become even more apparent by reference to the following examples which are included for purposes of illustration and which are in no way intended to limit the scope of the invention.

EXAMPLE I

In this example, a series of grease compositions were prepared and then tested for salt water corrosion resistance. In all compositions, the base grease was prepared in accordance with the procedure described in Example 2 of U.S. Pat. No. 3,758,407 by thickening a solvent 600 neutral base oil stock with a mixture of lithium soaps. The thickening was accomplished by adding 13.9 wt.% 12-hydroxystearic acid and 6.3 wt.% methylsalicylate to the base oil stock, heating to 160° F. and then adding an aqueous solution of 1.1 wt.% boric acid and 6.2 wt.% lithium hydroxide monohydrate. The mixture was then heated to 370° F. to effect dehydration and to form the thickener system. After thickening the grease was cooled and conventional antioxidants and a pour depressant were added to the grease formulation prior to passing the grease through a colloid mill. A portion of the grease thus prepared was then tested for salt water corrosion resistance. Five additional portions of the grease were then further formulated to contain at least one component of a corrosion inhibitor within the scope of the present invention. In each case, the salt water corrosion inhibitor component or components were added at room temperature of the grease after milling. After the further formulation each sample was tested for salt water corrosion resistance.

The salt water corrosion resistance test actually used was a modification of the procedure given in ASTM-D-1743. The test modifications include the substitution of either a 5% solution or a 10% solution in distilled water of the synthetic sea water described in ASTM-D-665-IP-135 for the distilled water required by the original ASTM-D-1743 method. Another modification involves storing the wetted, greased bearings for 24 hours at 125° F. instead of the storage for 48 hours at 125° F. as called for in the original method. However, the rating system used was the same as given in the ASTM procedure. The composition of each of the six portions and the corrosion resistance results actually obtained are summarized in the table set forth below:

| | Grease No. | | | | | |
|---|---|---|---|---|---|---|
| Composition, Wt. % | 1 | 2 | 3 | 4 | 5 | 6 |
| Grease | 100.0 | 98.5 | 98.0 | 96.5 | 96.5 | 96.5 |
| Dimethyl Dicoco Ammonium Nitrite | — | 1.5 | — | 1.5 | 1.5 | 1.5 |
| Zinc Naphthenate | — | — | 2.0 | 2.0 | — | — |
| Lead Naphthenate | — | — | — | — | 2.0 | — |

-continued

| Composition, Wt. % | Grease No. 1 | 2 | 3 | 4 | 5 | 6 |
|---|---|---|---|---|---|---|
| Lithium Naphthenate | — | — | — | — | — | 2.0 |
| Rust Ratings | 3,3,3 | 3,3,3 | 3,3,3 | 1,1,1 | 1,1,1 | 1,1,1 |

From the foregoing, it is believed readily apparent that while neither component of the multi-component salt water corrosion inhibitor of the present invention is effective in improving the salt water corrosion resistance of the base grease composition when used alone, excellent results are achieved when the two components are used in combination. The two component system is, then, surprisingly effective in lithium thickened greases.

EXAMPLE II

To show the advantages of the composition of this invention when involved in applications involving rubber seals and other rubber components, rubber swell data was obtained using two different types of rubber fluorocarbon elastomers, i.e. Viton and Fluorel. Tests were conducted at 300° F. for 70 hours. Results are as follows.

| | Viton | | Fluorel | |
|---|---|---|---|---|
| | % Swell | Condition | % Swell | Condition |
| Grease (100% wt; composition) | −4.7 | Soft, flexible | −0.8 | Soft, flexible |
| 1.0 wt. % Amino Imidazoline (mixed heptadecenyl heptadecadienyl imidazoline diamine) + 1.4 wt. % dicoco dimethyl ammonium nitrite | 5.4 | Hard, brittle | 1.0 | Hard, brittle |
| 2.0 wt. % Zinc Naphthenate + 1.5 wt. % dicoco dimethyl ammonium nitrite | 1.9 | Soft, flexible | −2.1 | Soft, flexible |

The grease composition was essentially the same as prepared in Example I with the 100% grease composition having 13.6 wt.% of 12-hydroxystearic acid, 6.2 wt.% of methyl salicylate, 1.1 wt.% of boric acid and 5.9 wt.% of lithium hydroxide monohydrate. The grease compositions containing the rust inhibiting additives were essentially the same and contained 12.3 wt.% of 12-hydroxystearic acid, 5.5 wt.% of methyl salicylate, 0.9 wt.% of boric acid and 5.1 wt.% of lithium hydroxide monohydrate.

As can be seen from the results, the use of the rust inhibiting additive of this invention, i.e. zinc naphthenate and quaternary ammonium nitrite, left the rubber in a soft, flexible state whereas use of another rust inhibiting combination of amino imidazoline and quaternary ammonium nitrite left the rubber in the undesirable condition of being hard and embrittled.

What is claimed is:

1. A lubricating grease composition comprising a major proportion of base oil, from about 2 to about 30 wt.% of a thickener system whose components include a lithium soap of a $C_{12}$ to $C_{24}$ hydroxy fatty acid and a monolithium salt of boric acid and a rust inhibiting amount of a combination of metal naphthenate wherein the metal is selected from the metals of Group I to IV of the Mendeleev periodic table and a quaternary ammonium salt having di-lower alkyl groups of about 1 to about 3 carbon atoms and additional dialkyl groups of about 8 to about 24 carbon atoms.

2. The composition of claim 1 wherein the metal in said metal naphthenate is selected from the group consisting of the alkali, alkaline earth and heavy metals and the quaternary ammonium salt is a dimethyl, dialkyl ammonium salt wherein the alkyl groups contain from about 10 to about 20 carbon atoms.

3. The composition of claim 2 wherein from about 0.05 to about 10 wt.% of said metal naphthenate and from about 0.05 to about 10 wt.% of said quaternary ammonium salt are used.

4. The composition of claim 3 wherein the metal in said metal naphthenate is selected from the group consisting of zinc, lead, lithium and magnesium and the alkyl groups in said dimethyl, dialkyl ammonium salt contains from about 12 to about 18 carbon atoms.

5. The composition of claim 4 wherein said quaternary ammonium salt is quaternary ammonium nitrite.

6. The composition of claim 4 wherein from about 5 to about 20 wt.% of said thickener system, about 0.1 to about 5 wt.% of said metal naphthenate and about 0.1 to about 5 wt.% of said quaternary ammonium salt are used.

7. The composition of claim 6 wherein said quaternary ammonium salt is dimethyl dicoco ammonium nitrite.

8. The composition of claim 6 wherein said hydroxy fatty acid has about 16 to about 20 carbon atoms.

9. The composition of claim 8 wherein said metal naphthenate is selected from the group consisting of zinc, lead and lithium naphthenate and said quaternary ammonium salt is dimethyl dicoco ammonium nitrite.

10. The composition of claim 9 wherein said hydroxy fatty acid is 12-hydroxystearic acid.

11. The composition of claim 4 wherein said thickening system comprises at least one lithium soap derived from a fatty acid containing a functional group selected from the group consisting of hydroxy, epoxy and an ethylenic unsaturated group and at least one dilithium soap derived from a straight chain dicarboxylic acid.

12. The composition of claim 1 wherein said base oil is a mineral oil.

* * * * *